US009009994B2

(12) United States Patent
Hren et al.

(10) Patent No.: US 9,009,994 B2
(45) Date of Patent: Apr. 21, 2015

(54) ROPE SHOVEL WITH CURVED BOOM

(71) Applicant: Harnischfeger Technologies, Inc., Wilmington, DE (US)

(72) Inventors: William J. Hren, Wauwatosa, WI (US); Rainer Poetter, North Prairie, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 14/305,680

(22) Filed: Jun. 16, 2014

(65) Prior Publication Data

US 2014/0294550 A1 Oct. 2, 2014

Related U.S. Application Data

(63) Continuation of application No. 13/363,053, filed on Jan. 31, 2012, now Pat. No. 8,756,839.

(60) Provisional application No. 61/438,458, filed on Feb. 1, 2011.

(51) Int. Cl.

| | |
|---|---|
| ***E02F 3/60*** | (2006.01) |
| ***E02F 3/30*** | (2006.01) |
| ***E02F 9/14*** | (2006.01) |
| ***E21C 27/30*** | (2006.01) |
| ***E02F 3/38*** | (2006.01) |

(52) U.S. Cl.

CPC . *E02F 3/308* (2013.01); *E02F 9/14* (2013.01); *E21C 27/30* (2013.01); *E02F 3/38* (2013.01)

(58) Field of Classification Search

USPC ..... 37/394–399, 443; 414/685

See application file for complete search history.

(56) References Cited

U.S. PATENT DOCUMENTS

| | | | |
|---|---|---|---|
| 1,747,946 | A | 2/1930 | Mitchell et al. |
| 1,797,224 | A | 3/1931 | Brey |
| 1,813,110 | A | 7/1931 | Bauer |
| 1,817,905 | A | 8/1931 | Bager et al. |
| 1,905,191 | A | 4/1933 | Snow, Jr. |
| 2,191,696 | A | 2/1940 | Jacoby et al. |
| 2,200,315 | A | 5/1940 | Weimer |
| 2,911,111 | A | 11/1959 | Grove |

(Continued)

FOREIGN PATENT DOCUMENTS

| | | |
|---|---|---|
| CN | 102628286 | 8/2012 |

OTHER PUBLICATIONS

Engineering and Mining Journal cover, Sep. 2009.

(Continued)

*Primary Examiner* — Matthew D Troutman

(74) *Attorney, Agent, or Firm* — Michael Best & Friedrich LLP

(57) ABSTRACT

A mining shovel includes a digging assembly having a generally V-shaped boom including a lower connection point for attachment to the mining shovel. A first portion of the boom extends generally upwardly from the lower connection point, and a second portion of the boom is angled with respect to and extends upwardly and forwardly from the first portion. The second portion includes a distal end defining a sheave support, and a pivot element is positioned generally at a connection area between the first portion and the second portion. The digging assembly also includes a boom attachment having a first end that is pivotally supported by the pivot element and a second end that is supported by the sheave support.

37 Claims, 4 Drawing Sheets

(56) References Cited

U.S. PATENT DOCUMENTS

| | | | |
|---|---|---|---|
| 3,049,252 | A | 8/1962 | Noll |
| 3,184,085 | A | 5/1965 | Randall et al. |
| 3,863,786 | A | 2/1975 | Frank |
| 3,933,260 | A | 1/1976 | Kronlokken et al. |
| 4,167,072 | A | 9/1979 | Johansson |
| 4,469,594 | A | 9/1984 | Poetter |
| 5,822,892 | A | 10/1998 | Ohbatake et al. |
| 6,401,370 | B1 | 6/2002 | Blom et al. |
| 6,434,862 | B1 | 8/2002 | Hren |
| 8,297,906 | B2 | 10/2012 | Nabata et al. |
| 8,756,839 | B2 | 6/2014 | Hren et al. |
| 2010/0193308 | A1 | 8/2010 | Nowaczyk et al. |
| 2014/0037414 | A1 | 2/2014 | Hren et al. |

OTHER PUBLICATIONS

Notification of First Office Action from The State Intellectual Property Office of the People's Republic of China for Chinese Application No. 201320587719.0 dated Jan. 28, 2014 (1 page).

Notification of the First Invitation to Correct Defects from the State Intellectual Property Office of the People's Republic of China for Chinese Application No. 201220032215.8 dated Jul. 19, 2012 (4 pages).

ROPE SHOVEL WITH CURVED BOOM

CROSS REFERENCE TO RELATED APPLICATION

This application is a continuation of co-pending, prior-filed U.S. application Ser. No. 13/363,053, filed Jan. 31, 2012, which claims the benefit of and priority to U.S. Provisional Patent Application Ser. No. 61/438,458, filed Feb. 1, 2011. The entire contents of both documents are incorporated by reference herein.

BACKGROUND

The present invention relates to rope shovels used for example in the mining and the construction industries.

In the mining field, and in other fields in which large volumes of materials must be collected and removed from a work site, it is typical to employ a power shovel including a large dipper for shoveling the materials from the work site. After filling the dipper with material, the shovel swings the dipper to the side to dump the material into a material handling unit, such as a dump truck or a local handling unit (e.g., crusher, sizer, or conveyor). Generally, the shovels used in the industry include hydraulic shovels and electric rope shovels. Electric rope shovels typically include a shovel boom that supports a pulling mechanism that pulls the shovel dipper thereby producing efficient dig force to excavate the bank of material. Conventional electric rope shovels include a relatively straight boom that is mounted at forty five degrees with respect to a horizontal plane (e.g., the ground).

SUMMARY

In some aspects the invention provides a digging assembly for a mining shovel. The assembly includes a generally V-shaped boom including a lower connection point for attachment to the mining shovel. A first portion of the boom extends generally upwardly from the lower connection point, and a second portion of the boom is angled with respect to and extends upwardly and forwardly from the first portion. The second portion includes a distal end defining a sheave support, and a pivot element is positioned generally at a connection area between the first portion and the second portion. The assembly also includes a boom attachment (also known as a boom handle) having a first end that is pivotally supported by the pivot element and a second end that is connected to a dipper.

In other aspects the invention provides a digging assembly for a mining shovel. The assembly includes a generally V-shaped boom including a lower connection point for attachment to the mining shovel. A first portion of the boom extends generally upwardly from the lower connection point, and a second portion of the boom is angled with respect to and extends upwardly and forwardly from the first portion. The second portion includes a distal end defining a sheave support, and a pivot element is positioned between about zero degrees and about 10 degrees from a vertical line extended directly upwardly from the lower connection point. The assembly also includes a boom attachment having a first end that is pivotally supported by the pivot element and a second end that is connected to a dipper.

In still other aspects the invention provides a mining shovel that includes a lower base and an upper base rotatably mounted on the lower base for rotation relative to the lower base. A generally V-shaped boom includes a lower connection point for attachment to the upper base, a first portion extending generally upwardly from the lower connection point, and a second portion angled with respect to and extending upwardly and forwardly from the first portion. The second portion includes a distal end defining a sheave support. A pivot element is positioned generally at a connection area between the first portion and the second portion. A sheave is rotatably supported by the sheave support. A boom attachment has a first end that is pivotally supported by the pivot element and a second end that is connected to a dipper. A rope extends from the upper base, over the sheave, and is connected to the dipper for support thereof.

In still other aspects the invention provides a mining shovel that includes a lower base and an upper base rotatably mounted on the lower base for rotation relative to the lower base. A generally V-shaped boom includes a lower connection point for attachment to the upper base, a first portion extending generally upwardly from the lower connection point, and a second portion angled with respect to and extending upwardly and forwardly from the first portion. The second portion includes a distal end defining a sheave support. A pivot element is positioned between about zero degrees and about 10 degrees from a vertical line extended directly upwardly from the lower connection point. A sheave is rotatably supported by the sheave support. A boom attachment has a first end that is pivotally supported by the pivot element and a second end connected to a dipper. A rope extends from the upper base, over the sheave, and is connected to the dipper for support thereof.

Other aspects of the invention will become apparent by consideration of the detailed description and accompanying drawings.

Figure 1:
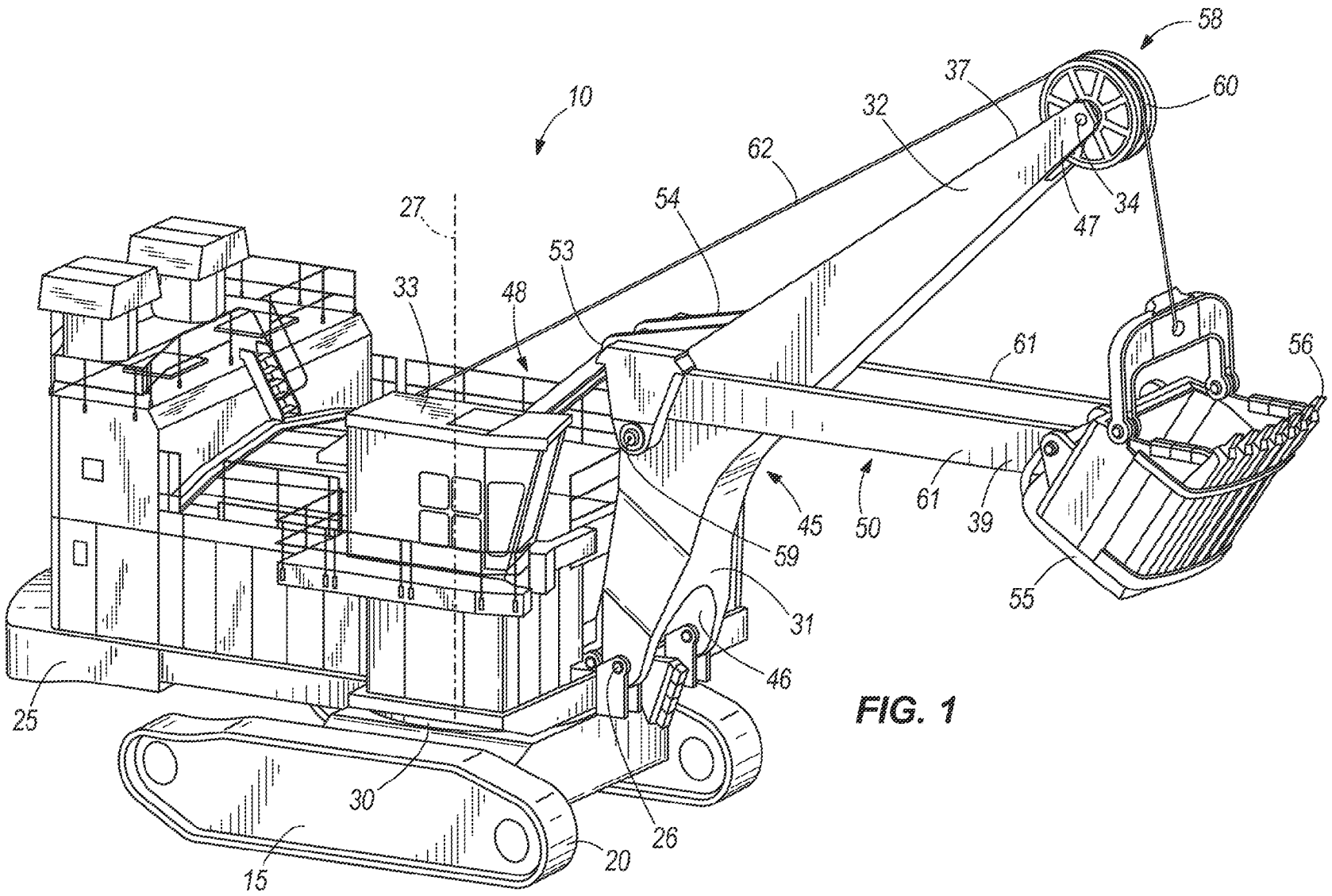
FIG. 1 is a perspective view of an electric rope shovel according to an embodiment of the invention.

It is to be understood that the invention is not limited in its application to the details of the construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION

FIGS. 1-4 illustrate an electric rope shovel 10 including a lower base 15 that is supported on drive tracks 20. The electric shovel 10 further includes an upper base 25 (also called a deck) positioned on a rotational structure 30 that is mounted to the lower base 15. The rotational structure 30 allows rotation of the upper base 25 relative to the lower base 15. The rotational structure defines a center line of rotation 27 of the shovel 10 (see FIG. 4). The center line of rotation 27 is perpendicular to a plane 28 defined by the lower base 15 and generally corresponding to the grade of the ground. In one embodiment, the upper base 25 includes, among other elements, an operating area 33 used by an operator or a driver to operate the electric rope shovel 10. As used herein, the terms "above," "upwardly," "vertically," and the like assume the drive tracks 20 are positioned on level ground such that the center line of rotation 27 is substantially vertical.

The electric rope shovel 10 further includes a boom 45 extending upwardly from the upper base 25. The boom 45 includes a first end 46 coupled to the upper base 25 and a second end 47. The boom 45 is curved and has "banana" or a "V" shape. The boom 45 is coupled to the upper base 25 at a point 26 via pin joints or other suitable attachment mechanisms. In some embodiments, the boom 45 comprises a generally vertical first portion 31 that extends generally upwardly from the base 25, and a second portion 32 that extends at an angle 92 from the first portion 31 toward the second end 47. The second end 47 of the boom 45 is remote from the base 25. In one embodiment, the boom 45 comprises a one piece construction combining the first and the second portions of the boom. In other embodiments, the boom 45 comprises two pieces, where the two portions of the boom 45 are securely attached to one another via welding, pin joints, fasteners, or any other attachment mechanisms.

The first portion 31 of the boom 45 is angled with respect to the second portion 32 of the boom. In some embodiments, the angle 92 between the first portion 31 and the second portion 32 of the boom can be between about one hundred and twenty degrees and about one hundred and sixty degrees. More specifically, the angle 92 between the first portion 31 and the second portion 32 can be approximately one hundred and sixty degrees. In other words, the second portion 32 of the boom 45 is offset between about twenty and about sixty degrees from the first portion 31 of the boom 45. In particular, the offset between the second portion 32 of the boom 45 and the first portion 31 can be twenty degrees.

The electric rope shovel 10 also includes a digging attachment comprising a boom attachment 50 (also called a boom handle) pivotally and slidably coupled to the boom 45 and a dipper 55 rigidly coupled to an end 39 of the boom attachment 50. In other embodiments. The dipper 55 can be moveably (e.g., pivotally) attached to the boom handle 50. Together the boom 45, the boom attachment 50, and the dipper 55 define a digging assembly of the shovel 10. The dipper 55 includes dipper teeth 56 and is used to excavate the desired work area, collect material, and transfer the collected material to a desired location (e.g., a material handling vehicle).

A pulling mechanism 58 is mounted on a second end 47 of the boom 45 and partially supports the boom handle 50 and the dipper 55. In some embodiments, the pulling mechanism 58 comprises a pulley or boom sheave 60 and a flexible hoist rope 62 that extends from the base 25, upwardly along the boom 45 and over the boom sheave 60, and downwardly to an attachment point on the dipper 55. The flexible hoist rope 62 is wrapped around a hoist drum 63 mounted on the upper base 25 of the electric shovel 10. The hoist drum 63 is powered by an electric motor (not shown) that provides turning torque to the drum 63 through a geared hoist transmission (not shown).

The sheave 60 is rotatably coupled to the second end 47 of the boom 45 between a pair of sheave support members 37 located at the second end 47 of the boom 45. A rod or a load pin 34 extends between the sheave support members 37 and through the sheave 60, thereby rotatably coupling the sheave 60 to the boom 45. Thus, the sheave 60 rotates about the rod or the load pin 34. In other embodiments, alternative mechanisms for connecting the sheave 60 to the boom 45 can be used. Rotation of the hoist drum 63 reels in and pays out the hoist rope 62, which travels over the sheave 60 and raises and lowers the dipper 55.

The electric shovel 10 also includes a strut mechanism 48 for supporting the boom 45 in an upright position relative to the base 25. The strut 48 includes two parallel strut legs 49 coupled by rigid-connect members 51. One end 52 of the strut 48 is rigidly mounted on the base 25 at a location spaced apart from the first end 46 of the boom 45. A second end 53 of the strut 48 is coupled to the boom 45 by connecting each strut leg 49 to a depending portion 54 of the boom 45. In some embodiments, the second end 53 of the strut 48 is coupled to the general area where the first portion 31 and the second portion 32 of the boom 45 connect or intersect. The strut 48 supports the boom 45 in the upright position. The strut 48 of the shovel 10 allows to eliminate one major structural member used in a conventional shovel (i.e., the gantry structure) and the suspensions ropes also used in a conventional shovel.

In some embodiments, the strut 48 is pivotally connected to the base 25 and to the boom 45 via moving pin joints or other types of connectors. The strut 48 can be provided with shock absorbing connectors such as various types of spring assemblies incorporated into the pinned attachment joints between the strut 48, the base 25, and the boom 45. These shock absorbing connectors can reduce the overall stiffness of the strut assembly when compression and tension forces are acting on the strut, thereby reducing shock loading and in turn reducing the overall stresses experienced by the various components.

The curved boom 45 can be used with a variety of differently configured boom handles 50. For example, in the embodiments of FIGS. 1-3 the boom handle 50 includes two substantially straight and parallel elongated handle members 61 positioned on either side of the boom 45. On the other hand, in the embodiment of FIG. 4, the boom handle 50 includes an upper arm 64 and a lower arm 65. The upper arm 64, and consequently the boom handle 50, is pivotally attached to a portion of the boom 45 generally where the first portion 31 and the second portion 32 of the boom 45 connect or intersect. In the illustrated embodiment, the upper arm 64 includes parallel upper arm members 43, such that one upper arm member 43 extends to each side of the boom 45. The lower arm 65 of the boom handle 50 is mechanically connected to the upper arm 64, and is driven by the upper arm 64. In some embodiments, the lower arm 65 is connected to the upper arm 64 via free moving pin joints, but other mechanical connections such as cams, linkages, gear sets, and the like may also be used to achieve the desired relative movement between the upper arm 64 and the lower arm 65.

Figure 4:
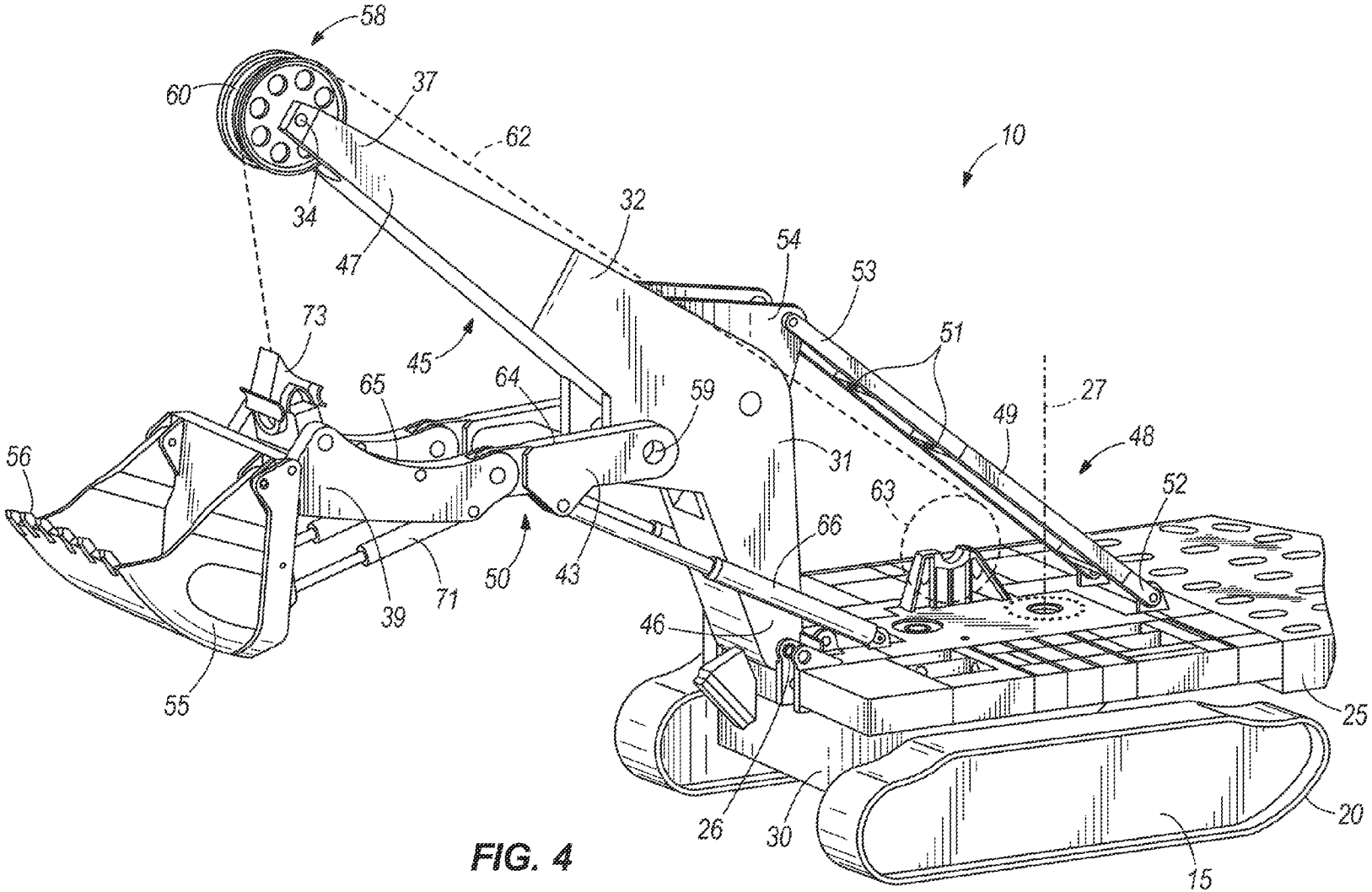
FIG. 4 is a perspective view another embodiment of an electric rope shovel.

With continued reference to the embodiment of FIG. 4, the boom handle 50 is driven by one or more hydraulic cylinders 66 that extend between at least one of the upper arm 64 and the lower arm 65 and at least one of the boom 45 and the base 25. In the illustrated construction, two hydraulic cylinders 66 are used, with one cylinder 66 positioned on each side of the boom 45. The hydraulic cylinders 66 pivot the upper arm 64 with respect to the boom 45 and thrust the lower arm 65 and the dipper 55 into the bank of material that is being excavated. The dipper 55 is moveably (e.g., pivotally) connected to the distal end of the lower arm 65. At least one actuator 71 in the form of a hydraulic cylinder extends between the dipper 55 and the lower arm 65 and is operable to move the dipper 55 relative to the lower arm. Other types of actuators can be used and can alternatively be coupled to the upper arm 64 or to an intermediate structure (not shown) coupled to one or both of the upper arm 64 and the lower arm 65.

Figure 2:
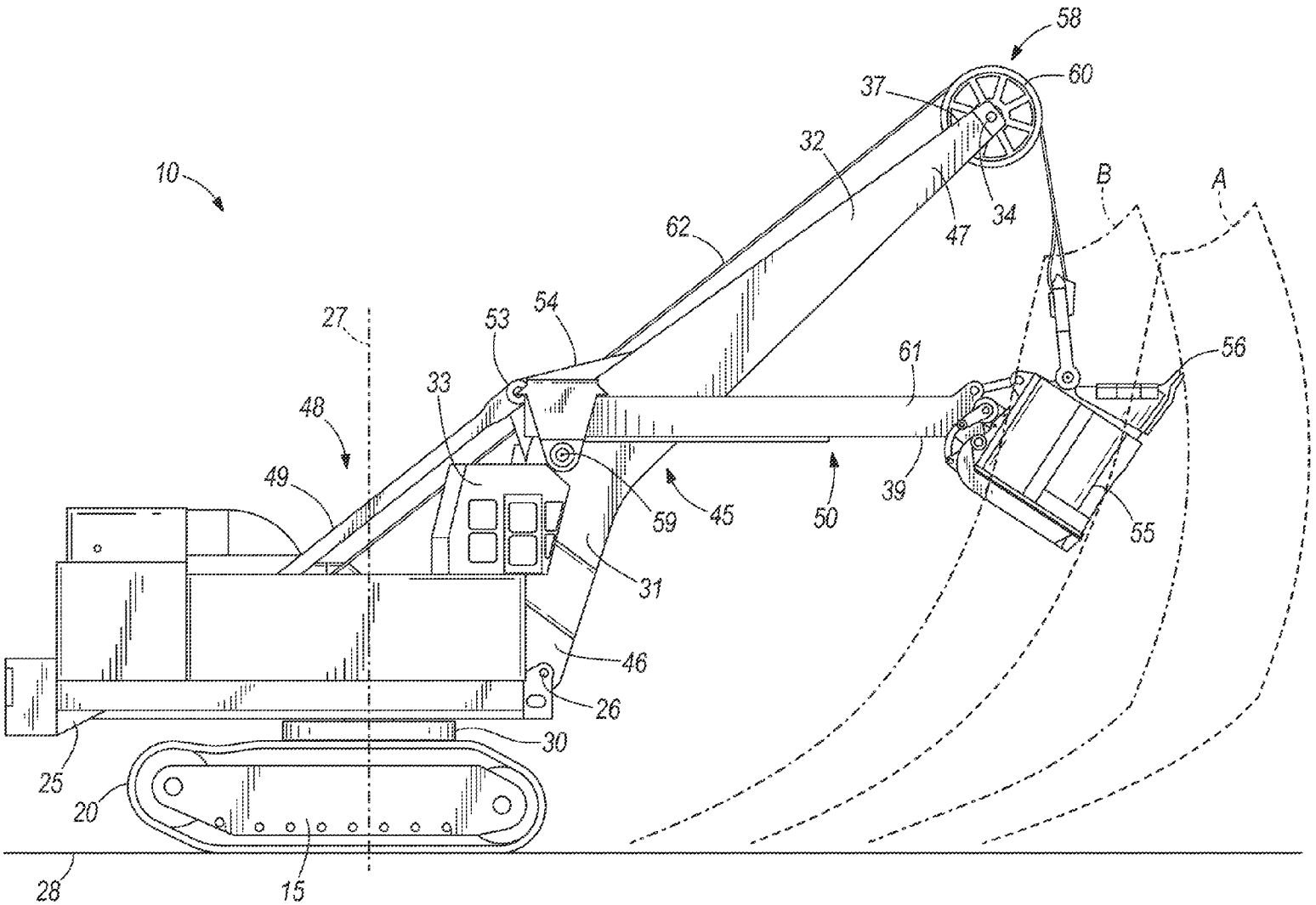
FIG. 2 is a side view of the electric rope shovel of FIG. 1 with some portions removed and showing a reach comparison between a conventional boom A and a curved boom B.
Figure 3:
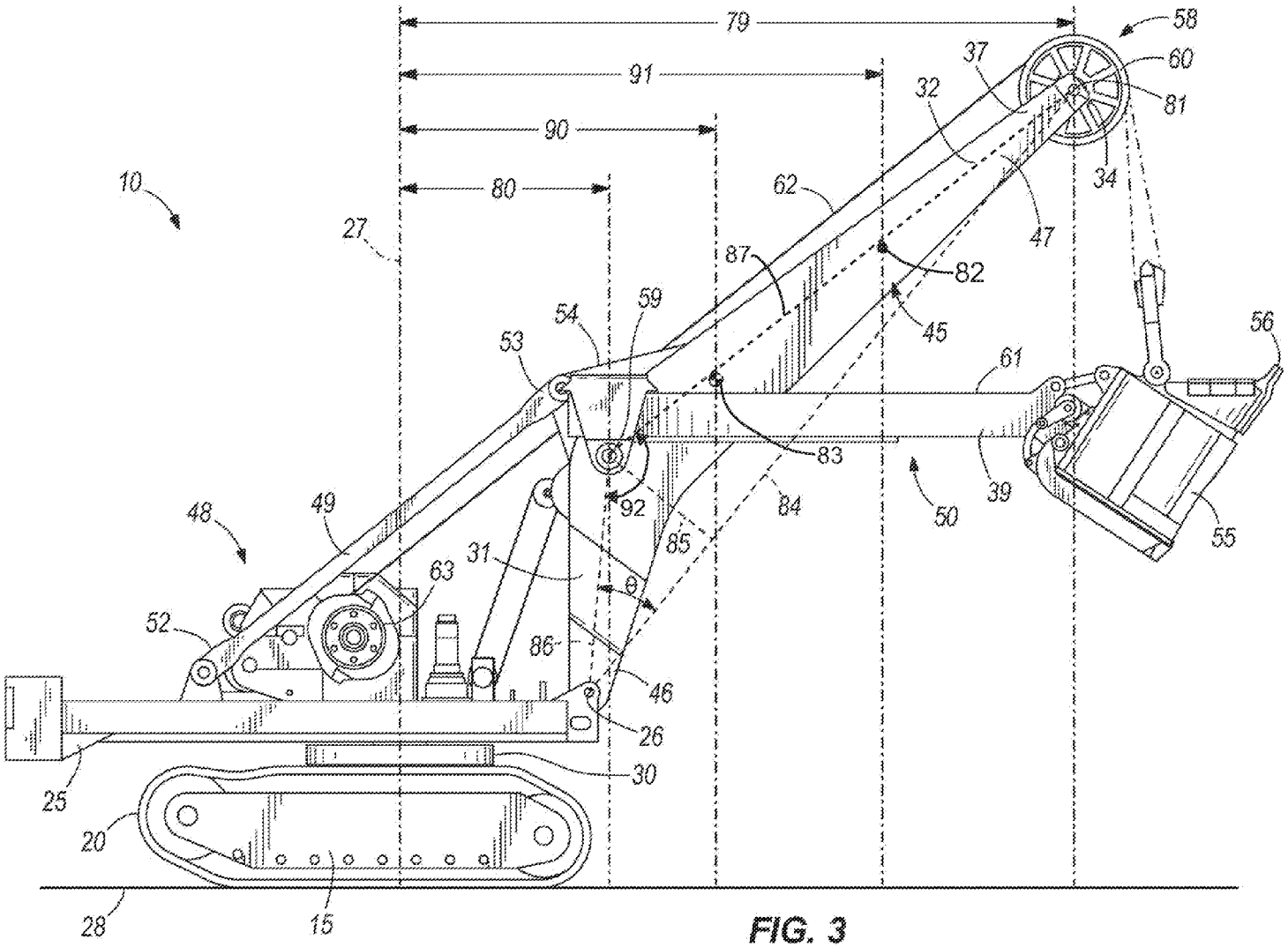
FIG. 3 is a side view of the electric rope shovel of FIG. 1 with additional portions removed and illustrating the relative locations of the centers of gravity of certain components of the shovel.

Regardless of whether the shovel has the boom attachment 50 of FIGS. 1-3 or the boom attachment 50 of FIG. 4, the boom attachment 50 is also supported by the sheave 60 via the hoist rope 62. For that purpose, the boom attachment includes a connecting mechanism that engages the hoist rope 62 and connects the boom attachment with the sheave 60 (see FIG. 5). In one embodiment, the connecting mechanism comprises an equalizer 73 coupled to the lower arm 65. In alternative embodiments (e.g., when the hydraulic cylinders driving the dipper are attached to the upper portion of the dipper), the equalizer 73 is positioned near the pivot point of the lower arm 65 and the dipper, and the hoist rope 62 passes between the actuators 71 to reach the equalizer. Where more than one hoist rope is used, the equalizer 73 can sense the tension applied on each hoist rope 62 and is operable to equalize the tension in the two hoist ropes 62. In other embodiments, different types of connecting mechanisms can be used to connect the sheave 60 and the boom attachment 50 and the dipper 55.

As shown in FIGS. 1-4, the boom 45 includes a pivot element or pivot point 59 (e.g., a shipper shaft or a pin depending on the type of boom handle 50) that pivotally supports the boom handle 50. The pivot point 59 of the curved boom 45 is located significantly closer to the center line of rotation 27 of the shovel 10 when compared to the pivot point location for a conventional straight boom. For example, in some embodiments, the pivot point 59 is about nine feet closer to the axis of rotation 27 that it would be if the boom 45 was a conventional straight boom. Thus, as shown in FIG. 2, the maximum reach of the dipper 10 (shown as B) is closer to the base and to the center line of rotation 27 when compared to the reach of the convectional dipper (shown as A). The center of gravity 83 of the curved boom 45 is also closer to the center line of rotation 27 than the center of gravity of a conventional boom. Consequently, less counterweight is required to support the digging attachment and the overall machine weight and inertia is reduced.

In some embodiments, the pivot point 59 of the boom handle is positioned approximately at the general area where the first portion 31 and the second portion 32 of the boom 45 connect or intersect. In some embodiments, the pivot point 59 is positioned substantially directly above the point of connection 26 between the first portion 31 of the boom 45 and the upper base 25. For example, depending on the particular construction of the boom, the pivot point 59 can be positioned between about zero degrees and about ten degrees from a vertical line drawn directly upwardly from the point of connection 26. In other embodiments, the pivot point 59 can be positioned between about zero degrees and about five degrees from a vertical line drawn upwardly from the point of connection 26.

Because of the curved shape of the boom 45, the pivot point 59 of the boom handle 45 is moved substantially towards the base 25 and the center line of rotation 27 of the shovel 10. The relationship of different points along the boom 45 relative to the axis of rotation 27 and relative one another are illustrated in and discussed with respect to FIG. 3. The relevant points or locations along the boom 45 include the pivot point 59, the center of gravity 83 of the boom 45, a geometric center 82 of the second boom portion 32, and a pulley connection point 81 where the pulley 60 is rotatably coupled to the second boom portion 42. A pulley reference distance 79 is defined as the perpendicular distance from the axis of rotation 27 to the pulley connection point 81. A pivot point distance 80 is defined as the perpendicular distance from the axis of rotation 27 to the pivot point 59. A CG distance 90 is defined as the perpendicular distance from the axis of rotation 27 to the center of gravity 83 of the boom 45. A second portion center distance 91 is defined as the perpendicular distance from the axis of rotation 27 to the geometric center 82 of the second boom portion 32.

In some embodiments, the pivot point distance 80 is between about 20 percent and about 40 percent of the pulley reference distance 79. In other embodiments the pivot point distance 80 is between about 25 percent and about 35 percent of the pulley reference distance 79. In still other embodiments the pivot point distance 80 is about thirty percent of the pulley reference distance 79.

In some embodiments, the CG distance 90 is between about 35 percent and about 55 percent of the pulley reference distance 79. In other embodiments the CG distance 90 is between about 40 percent and about 50 percent of the pulley reference distance 79. In still other embodiments the CG distance 90 is about 45 percent of the pulley reference distance 79.

In some embodiments, the second portion center distance 91 is between about 55 percent and about 75 percent of the pulley reference distance 79. In other embodiments the second portion center distance 91 is between about 60 percent and about 70 percent of the pulley reference distance 79. In still other embodiments the second portion center distance 91 is about 65 percent of the pulley reference distance 79.

With continued reference to FIG. 3, reference line 84 extends between point 26 (i.e., the point of connection between the first portion 31 of the boom 45 and the upper base 25) and pulley connection point 81. Reference line 85 extends through the pivot point 59 and is perpendicular to reference line 84. In some embodiments, the length of reference line 85 is between about ¼ and about ⅛ of the length of reference line 84. In other embodiments the length of reference line 85 is between about ⅕ and about ⅐ of the length of reference line 84. In still other embodiments the length of reference line 85 is about ⅙ of the length of reference line 84.

Reference line 86 extends from point 26 to the pivot point 59. Reference line 87 extends from the pivot point 59 to the pulley connection point 81. In one embodiment, the angle 92 is defined between reference line 87 and reference line 86. In some embodiments, an angle θ between reference line 86 and reference line 84 is greater than about 10 degrees. In other embodiments, the angle θ is greater than about 20 degrees. In still other embodiments, the angle θ is greater than about 30 degrees.

Thus, the features of the curved boom 45 help the shovel 10 to increase its dipper dig forces up to 15% compared to the shovel having a straight boom. Specifically, the height of the pivot point 58 in relation to the plane 28, the position of the pulley connection point 81 relative to the pivot point 59, and the length of the handle 50 help to increase the dipper dig forces. This increase in digging force and efficiency allows manufacturers to downsize the hoist motor and the drive train of the shovel, thereby lowering the cost of the shovel.

Due to the curved shape of the boom 45, the electric shovel 10 significantly improves the direct line of sight of the shovel operator who wants to view parked dump trucks as he or she swings the shovel to side opposite to the operator's area 33 (i.e., the operator's blind side). Compared to the conventional straight boom, the curved boom 45 is shifted above and behind the line of sight of the operator as he or she looks to target the truck bed with a full dipper in order to adjust the location of the dipper over the waiting truck bed. Further, the curved boom 45 opens up the area in front and below the boom for greater dipper accommodation in the tuck back areas.

Various features and advantages of the invention are set forth in the following claims.

What is claimed is:

1. A digging assembly comprising:

a boom including a first end, a second end, and a pivot element, a first reference line extending between the first end and the second end and defining a first distance, the pivot element defining a pivot point, a minimum distance between the pivot point and the first reference line defining an offset distance, a ratio of the first distance to the offset distance being between 4:1 and 8:1;

a boom attachment movably supported by the pivot element, the boom attachment having a first end and a second end; and a digging attachment directly coupled to the second end of the boom attachment.

2. The digging assembly of claim 1, wherein the ratio of the first distance to the offset distance is between 5:1 and 7:1.

3. The digging assembly of claim 2, wherein the ratio of the first distance to the offset distance is approximately 6:1.

4. The digging assembly of claim 1, wherein the boom includes a first portion and a second portion that is angled relative to the first portion.

5. The digging assembly of claim 4, wherein an angle between the first portion and the second portion is between about 120 degrees and about 160 degrees.

6. The digging assembly of claim 4, wherein the pivot element is positioned proximate an area of connection between the first portion and the second portion.

7. The digging assembly of claim 1, wherein the pivot element is positioned substantially directly above the first end of the boom.

8. The digging assembly of claim 1, wherein the pivot element includes a pinion, and wherein the boom attachment includes a rack engaging the pinion such that the boom attachment is supported for translational movement relative to the pivot element.

9. The digging assembly of claim 1, wherein the boom is biased against rotation about the first end of the boom.

10. The digging assembly of claim 1, further comprising a sheave coupled to the second end of the boom and a rope extending over the sheave and coupled to the digging attachment.

11. The digging assembly of claim 1, wherein a second reference line extends from the first end of the boom to the pivot point, wherein an angle between the first reference line and the second reference line is greater than 10 degrees.

12. A digging assembly comprising:

a boom including a first end, a second end, and a pivot element, a first reference line extending between the first end and the second end and defining a first distance, the pivot element defining a pivot point, a second reference line extending between the first end and the pivot point, an angle between the first reference line and the second reference line being at least ten degrees;

a boom attachment movably supported by the pivot element, the boom attachment having a first end and a second end; and a digging attachment directly coupled to the second end of the boom attachment.

13. The digging assembly of claim 12, wherein the angle is at least 20 degrees.

14. The digging assembly of claim 13, wherein the angle is at least 30 degrees.

15. The digging assembly of claim 12, wherein the boom includes a first portion and a second portion that is angled relative to the first portion.

16. The digging assembly of claim 15, wherein an angle between the first portion and the second portion is between about 120 degrees and about 160 degrees.

17. The digging assembly of claim 12, wherein the pivot element is positioned substantially directly above the first end of the boom.

18. The digging assembly of claim 12, wherein the pivot element includes a pinion, and wherein the boom attachment includes a rack engaging the pinion such that the boom attachment is supported for translational movement relative to the pivot element.

19. The digging assembly of claim 12, further comprising a sheave coupled to the second end of the boom and a rope extending over the sheave and coupled to the digging attachment.

20. A mining shovel comprising:

a base including a first portion and a second portion that is rotatable relative to the first portion about an axis;

a boom including a first end coupled to the base, a second end, and a pivot element, the boom defining a first side proximate the axis and a second side opposite the first side, the boom having a first portion and a second portion connected to the first portion at a connection area, the first portion extending substantially vertically from the base, the second portion extending at an angle of between 120 degrees and 160 degrees relative to the first portion, the pivot element positioned between the first end and the second end and proximate the first side;

a boom attachment movably supported by the pivot element, the boom attachment having a first end and a second end; and a digging attachment directly coupled to the second end of the boom attachment.

21. The shovel of claim 20, wherein the pivot element is positioned proximate the connection area.

22. The shovel of claim 20, wherein the pivot element includes a pinion, and wherein the boom attachment includes a rack engaging the pinion such that the boom attachment is supported for translational movement relative to the pivot element.

23. The shovel of claim 20, wherein the angle between the first portion and the second portion is about 160 degrees.

24. The shovel of claim 20, further comprising a sheave coupled to the second end of the boom and a rope extending over the sheave and coupled to the digging attachment.

25. The shovel of claim 20, wherein the first portion extends between the first end and the pivot element, and the second portion extends between the second end and the pivot element.

26. A mining shovel comprising:

a base;

a boom including a first end coupled to the base, a second end, and a pivot element, a first reference line extending between the first end and the second end and defining a first distance therebetween, the pivot element defining a pivot point, a minimum distance between the pivot point and the first reference line defining an offset distance, a ratio of the first distance to the offset distance being between 4:1 and 8:1;

a sheave coupled to the second end of the boom;

a boom attachment movably supported by the pivot element, the boom attachment having a first end and a second end;

a digging attachment directly coupled to the second end of the boom attachment; and a rope extending from the base, over the sheave, and coupled to the digging attachment.

27. The shovel of claim 26, wherein the ratio of the first distance to the offset distance is between 5:1 and 7:1.

28. The shovel of claim 27, wherein the ratio of the first distance to the offset distance is approximately 6:1.

29. The shovel of claim 26, wherein the boom includes a first portion and a second portion angled relative to the first portion, and wherein an angle between the first portion and the second portion is between about 120 degrees and about 160 degrees.

30. The shovel of claim 29, wherein the pivot element is positioned proximate an area of connection between the first portion and the second portion.

31. The shovel of claim 26, wherein the pivot element includes a pinion, and wherein the boom attachment includes a rack engaging the pinion such that the boom attachment is supported for translational movement relative to the pivot element and rotational movement about the pivot element.

32. The shovel of claim 26, wherein a second reference line extends from the first end of the boom to the pivot point, wherein an angle between the first reference line and the second reference line is greater than 10 degrees.

33. A mining shovel comprising:

a base;

a boom including a first end coupled to the base, a second end, and a pivot element, a first reference line extending between the first end and the second end and defining a first distance therebetween, the pivot element defining a pivot point, a second reference line extending between the first end and the pivot point, an angle between the first reference line and the second reference line being at least ten degrees;

a sheave coupled to the second end of the boom;

a boom attachment movably supported by the pivot element, the boom attachment having a first end and a second end;

a digging attachment directly coupled to the second end of the boom attachment; and a rope extending from the base, over the sheave, and coupled to the digging attachment.

34. The shovel of claim 33, wherein the angle is at least 20 degrees.

35. The shovel of claim 34, wherein the angle is at least 30 degrees.

36. The shovel of claim 33, wherein the boom includes a first portion and a second portion angled relative to the first portion, an angle between the first portion and the second portion is between about 120 degrees and about 160 degrees.

37. The shovel of claim 33, wherein the pivot element includes a pinion, and wherein the boom attachment includes a rack engaging the pinion such that the boom attachment is supported for translational movement relative to the pivot element and rotational movement about the pivot element.

* * * * *